United States Patent [19]

Powell et al.

[11] Patent Number: 4,530,202

[45] Date of Patent: Jul. 23, 1985

[54] CONTAINER FILLING MACHINE AND METHOD

[75] Inventors: Roger M. Powell, Camberwell; Steven Marshall, Mentone; Philip D. Waterworth, Croydon North, all of Australia

[73] Assignee: ACI Australia Limited, Melbourne, Australia

[21] Appl. No.: 457,063

[22] Filed: Jan. 10, 1983

[30] Foreign Application Priority Data

Jan. 18, 1982 [AU] Australia ..... PF2319
Jan. 28, 1982 [AU] Australia ..... PF2475

[51] Int. Cl.[3] ..... B65B 55/04

[52] U.S. Cl. ..... 53/426; 53/468; 53/471; 141/57; 141/61; 141/90; 141/91

[58] Field of Search ..... 53/268, 281, 331.5, 53/381, 426, 468, 469, 471, 459, 482; 141/90, 91, 61, 57, 119; 269/254 R, 287

[56] References Cited

U.S. PATENT DOCUMENTS

| | | | |
|---|---|---|---|
| 2,546,418 | 3/1951 | Ardron et al. | 141/57 |
| 3,014,620 | 12/1961 | Moore | 141/119 |
| 3,159,395 | 12/1964 | Mussett et al. | 269/254 R |
| 3,390,891 | 7/1968 | Stichhan | 269/254 R |
| 3,783,581 | 1/1974 | Pierce | 53/471 |
| 4,077,182 | 3/1978 | Papaluca | 53/281 |
| 4,120,134 | 10/1978 | Scholle | 53/268 |
| 4,218,265 | 8/1980 | Fuchs et al. | 141/91 |
| 4,417,607 | 11/1983 | Scholl et al. | 53/426 |

FOREIGN PATENT DOCUMENTS

| | | | |
|---|---|---|---|
| 595248 | 2/1978 | Switzerland | 53/426 |
| 1086076 | 10/1967 | United Kingdom | 53/425 |

*Primary Examiner*—Francis S. Husar
*Assistant Examiner*—Jorji M. Griffin
*Attorney, Agent, or Firm*—Murray, Whisenhunt and Ferguson

[57] ABSTRACT

A machine and method for filling a container through an opening therein. The machine includes a machine frame defining a container conveying zone through which a container loaded into the machine moves during a filling operation. A container sterilizing assembly is mounted on the machine frame and defines a sterilizing station in the conveying zone, the sterilizing assembly being operable to aseptically sterilize the container, at least in a region incorporating the opening, when positioned at the sterilizing station. A container filling assembly is also mounted on the machine frame and defines a container filling station in the conveying zone, the filling assembly being operable to receive the sterilized container and fill the container through the opening therein with a product while maintaining at least the opening region of the container in an aseptic condition.

51 Claims, 11 Drawing Figures

CONTAINER FILLING MACHINE AND METHOD

This invention relates generally to a machine and method for filling a container with a product, and particularly to a machine and method for aseptically filling successive containers with a liquid food or drink product. The machine and method may be particularly applicable for filling flexible bag containers with liquid drinks easily susceptible to spoilage, such as milk, and it will be convenient to hereinafter describe the machine and method in relation to that example application. It should be appreciated, however, that the machine and method is not limited to that exemplary application.

When an untreated and unprotected food or drink product is stored at ambient temperatures, the activity of naturally occurring bacterial organisms can cause that food or drink to spoil in a relatively short period. Storing the product under refrigeration is well recognized as a means of retarding the activity of those organisms and thereby extending the product shelf life, although there can be a high cost involved in refrigerated transportation and storage. As an alternative, the product can be treated by means of the addition of chemical preservatives to retard bacterial organism activity but society in general is becoming increasingly wary of apparent ill affects of such preservatives currently used.

Treating food or drink products with a pasteurising process in which the food and drink is subjected to the application of heat, is also well recognised as a means of destroying bacterial organisms within that food or drink and thereby minimising product spoilage. In a conventional pasteurising process, most foods and drinks become cooked and undergo chemical changes which can affect their characteristics, particularly their taste. A relatively recently developed pasteurising process, identified as ultraheat treatment (UHT) process, however, has been found to destroy bacterial organisms within some food and drink products with minimal damage to product characteristics. The UHT process is based upon raising the food or drink product to a very high temperature for a short period and then rapidly cooling that product to ambient temperature. Once back at ambient temperature, however, some products are again susceptible to spoilage.

Milk can be particularly susceptible to bacterial organism contamination and thus spoilage and none of the above outlined means are entirely satisfactory for preventing that spoilage. In consequence, it is necessary for marketers of milk products to market the milk in a container which will maintain the milk within a sterile atomsphere from final production stage until ultimate consumer use so as to minimise bacterial organism contamination. Such successful maintenance means that the milk can be transported and stored for extended periods without the need of critical refrigeration, added preservatives, pasteurisation or other bacterial organisms destroying means.

A recently developed container for storing and marketing milk, particularly to large users, is a flexible bag composed of sheet material, such as a plastic or plastic/-metal laminate, having a closure assembly through which milk can be poured into and from the bag. It has been found that these bag containers can generally maintain the milk in an unspoiled condition provided the containers are sterilized prior to filling and the container is filled with minimum, if any, contamination of either the container or milk. However, machines and methods presently available to fill such bag containers on a commercial scale do not achieve that satisfactorily, so that the useful life of the contained milk is reduced.

It is an object of the present invention to provide a container filling machine and method which alleviates the foregoing difficulty of prior filling machines and methods.

According to one aspect of the present invention, there is provided a machine for filling a container through an opening therein, including: a machine frame defining a container conveying zone through which a container loaded into the machine moves during a filling operation; a container. sterilizing assembly mounted on the machine frame and defining a sterilizing station in the conveying zone, the container sterilizing assembly operable to aseptically sterilize the container at least in a region incorporating the opening, when positioned at the sterilizing station; and, a container filling assembly at the mounted on the machine frame and defining a container filling station in the conveying zone, the container filling assembly being operable to receive the sterilized container and fill the container through the opening therein with a product whilst maintaining at least the opening region of the container in an aseptic condition.

According to another aspect of the present invention, there is provided a method for filling a container through an opening therein, including the steps of: loading the container into a container conveying zone; moving the container through the conveying zone to a sterilizing station; aseptically sterilizing the container at least in the region of the opening when positioned at the sterilizing station; moving the sterilized container along the conveying zone to a filling station; and, filling the container received at the filling station through the opening thereof with a product whilst maintaining at least in the opening region of the container in an aseptic condition.

Preferably, the machine frame defines an elongated conveying zone having an inlet through which an empty container is passed for loading into the zone, and an outlet through which a filled container passes to be discharged from the conveying zone. The conveying zone preferably, lies generally along one or more horizontal planes during machine operation.

Preferably, the machine frame is adapted, during machine operation, to enclose the conveying zone along its entire. longitudinal extent. Moreover, preferably, the inlet and outlet to that zone is selectively sealable, that being achieved by the inclusion of suitable inlet and outlet closure members in the machine frame. Because of the extent of this enclosure of the conveying zone during machine operation, contamination of the zone with atmosphere surrounding the machine can be minimised.

As an additional measure against contamination of the conveying zone with surrounding atmosphere, the conveying zone is supplied with a sterilizing gas which pressurizes and maintains the conveying zone at a pressure higher than the surrounding atmosphere. That sterilizing gas is preferably supplied from a zone pressurizing unit.

The machine of the present invention is preferably adapted to operate continuously so that a plurality of the containers are successively introduced into the machine and move through the conveying zone being filled and then discharged from the machine. Those containers are preferably stored adjacent the conveying zone for loading thereinto. Those containers may be loaded into the conveying zone in any suitable manner, such as manually. Those containers may be separate from each other or, to facilitate loading, severably interconnected in seriatim so that a pack of containers may be simultaneously loaded into the machine and then severed from each other before or after filling.

The machine of the present invention preferably also includes a container drive assembly operable to move the containers through the conveying zone. Preferably, that drive assembly is operable to step move the containers along the conveying zone. In this way, container movement steps can be so selected that container movement can be halted between preselected movement steps to allow machine functions to be completed on the containers whilst those containers are in a stop condition. The drive assembly is preferably arranged to ensure the general equal spacing between adjacent containers as they move through the conveying zone.

Preferably, the container sterilizing assembly is mounted on the machine frame such that the sterilizing station is positioned downstream of the conveying zone inlet. Moreover, preferably, the sterilizing assembly is so arranged that the sterilizing station can be generally isolated from the remainder of the conveying zone.

Preferably, the sterilizing assembly is adapted to sterilize containers, or at least a region of those containers, in two stages. For that reason, the sterilizing station preferably has two sub-stations at each of which a respective one of those sterilizing stages occurs, one sub-station being upstream of the other.

Preferably, the sterilizing assembly includes a preliminary sterilizing unit positioned within or adjacent the conveying zone, at the upstream sterilizing sub station, and operable to sterilize at least an outer surface of the containers or a holding bag in which one or more of the containers are loaded into the machine. In this way, contaminants which may be on the outer surface of the containers or holding bags during their storage or otherwise prior to loading into the machine can be sterilized. Preferably, the containers stop their movement through the conveying zone when in the upstream sterilizing sub station to allow proper sterilization by the preliminary sterilizing unit.

The preliminary sterilizing unit may wash cleanse the outer surface of the containers or packs of containers. That wash cleansing may be achieved by spray washing the outer surface with a chemical sanitising liquid and then drying that surface so as to remove traces of that liquid from the outer surface. The preliminary sterilizing unit may also be operable to generally immerse the containers in high frequency light rays such as low intensity ultraviolet light rays to assist in sterilization.

Preferably., the container sterilizing assembly also includes a main sterilizing unit positioned within or adjacent the conveying zone, at the downstream sterilizing sub-station, and operable to sterilize at least the opening region of the containers. In this way, contamination of the product during container filling is minimised. Preferably, the containers also stop their movement through the conveying zone when in the downstream sterilizing sub-station to allow proper sterilization by the main sterilizing unit.

The main sterilizing unit may be operable to immerse the opening region of the containers in high frequency light rays, such as high intensity ultraviolet light rays. That sterilizing unit may also immerse the container generally in high frequency light rays, such as low intensity ultraviolet light rays.

Preferably, the container filling assembly is mounted on the machine frame such that the filling station is positioned downstream of the sterilizing station. Preferably, the filling assembly is so constructed that the filling station can be generally isolated from the remainder of the conveying zone. Preferably, the filling station is positioned immediately downstream of the downstream sterilizing sub-station so that during machine operation containers move immediately from the sterilizing station to the filling station in preparation for filling.

Preferably, the filling assembly includes a container filling unit mounted within or adjacent the conveying zone and operable to fill containers in the filling station with a predetermined portion of product. The filling unit preferably has one or more guide elements extending from the sterilizing station, into and through the filling station for supportingly guiding successive containers from the sterilizing station into and through the filling station. Moreover, the filling unit preferably has one or more locating elements provided in the filling station and selectively operable to positively locate and firmly hold the containers, adjacent the opening thereof, in the filling station in a predetermined filling position for filling with the product. Preferably, when the locating elements hold the container, movement of that container and of succeeding containers through the conveying zone is stopped to allow container filling. This stoppage also provides the stoppage of successive container(s), within at least the downstream sterilizing sub-station. The locating elements are preferably so operable to releasably locate and hold the containers only during container filling.

The filling unit preferably also has a container filling head mounted within the conveying zone, the head being connectable to a source of product and operable to inject a portion of that product into a container, through the opening thereof, located and held by the locating elements in the filling station. The filling head is preferably mounted for movement relative to the held container so that, in machine operation, the head is projected into the container opening for injection of product and then withdrawn frdm the opening to allow the filled container to move from the filling station.

The machine of the present invention preferably further includes a container discharge assembly mounted on the machine frame and defining a discharge station in the conveying zone.

Preferably, the discharge assembly is operable to discharge a filled container, received at the discharge station from the filled station.

Preferably, the container discharge assembly is mounted on the machine frame such that the discharge station is positioned downstream of the filling station. Where the containers moving through the conveying zone are interconnected, the discharge assembly may include a severing unit to separate the containers to that they can pass individually through the conveying zone outlet from the machine.

The following description refers in more detail to the above and additional features of the present invention. To facilitate an understanding of the invention, reference is made to the accompanying drawings where the various features are illustrated in a preferred embodiment. It should be understood that the features of the invention are not limited to the specific embodiment of those features as shown in the drawings.

In the drawings:

FIG. 1. is a side elevational view showing the general assembly of a preferred embodiment of the container filling machine of the present invention;

FIG. 1*a* is a side elevation view illustrating a form of containers filled by the machine of FIG. 1;

Figure 1:
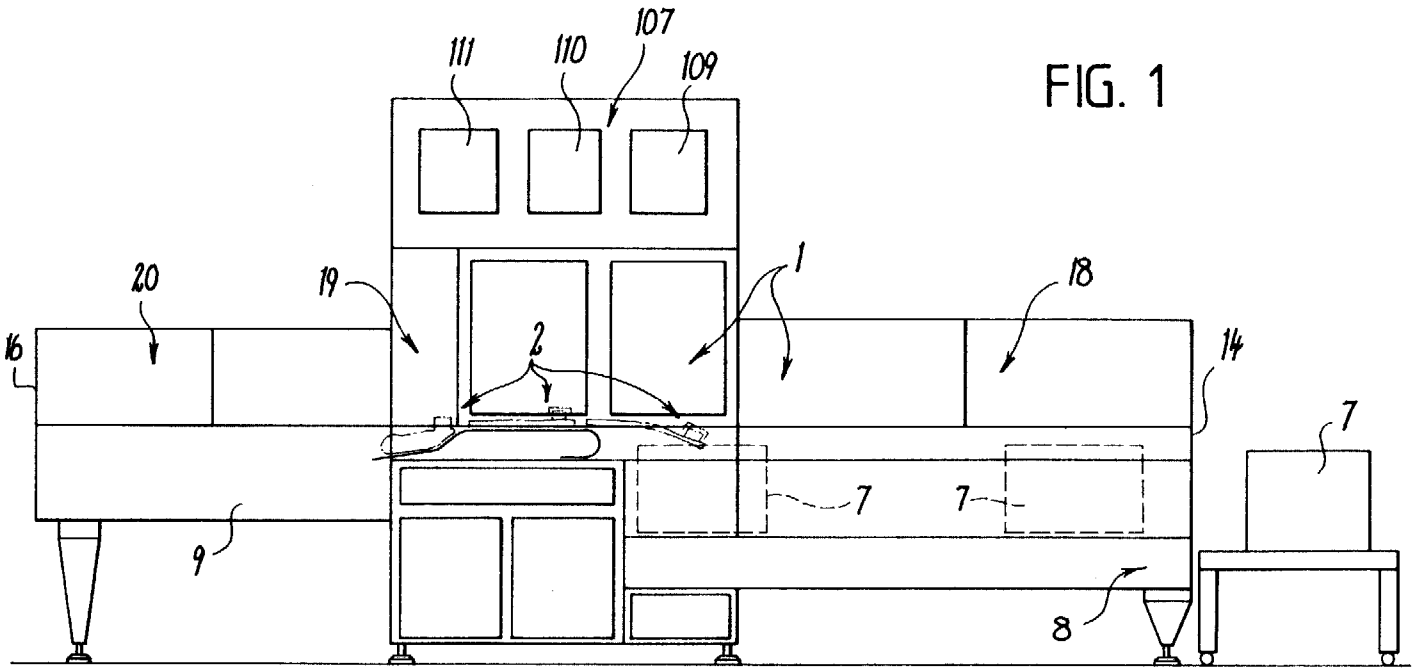
Figure 5:
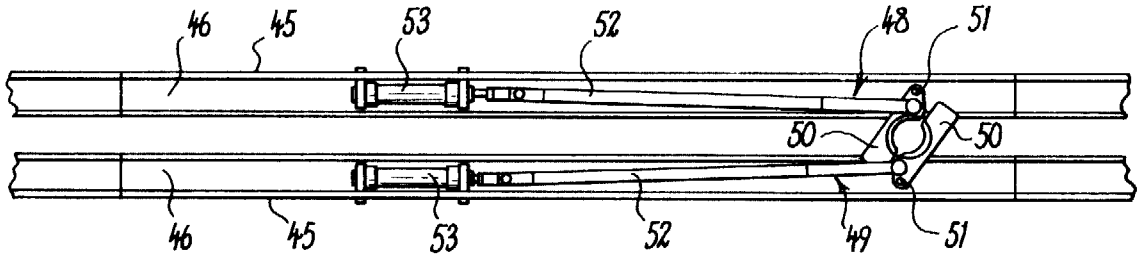
FIG. 5 is a detailed plan view of a machine part as seen from V—V of FIG. 4.
Figure 1A:
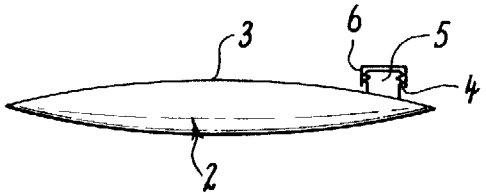

Referring initially to FIG. 1 and 1*a*, there is generally illustrated machine 1, for filling container 2, with a product (not shown). Container 2, includes plastic bag 3, with closure sleeve 4, sealingly mounted in bag 3, so as to define opening 5, into bag 3. Container 2, also has closure cap 6, releasably snap-connectable to sleeve 4, to close opening 5, A plurality of bag containers 2, are arranged into pack 7, bags 2, being interconnected in seriatim and fanfolded into a stack and stored in at least one plastic holding bag (not shown). Pack 7, may have previously been subjected to a sterilization process such as gamma ray radiation, prior to delivery to machine 2.

Machine 1, has frame 8, which defines generally horizontally extending conveying zone 9. Zone 9, is generally quadrangular and defined by bottom wall 10, top wall 11, and opposed side walls 12, 13 of frame 8. Conveying zone 9, has inlet 14, through which packs 7, are loaded into machine 1. Inlet 14, is selectively closable by inlet closure door 15, slidably mounted on frame 8. Conveying zone 9, also has outlet 16, through which filled containers 2, can pass from machine 1, following movement through conveying zone 9. Outlet 16, is selectively closable by outlet closure flap (not shown) hinged to frame 8, and pushed open upon pressure from containers 2, during machine operation.

Frame 8, is conveniently fabricated so as to include access hatches 17, for inspection and maintenance of machine 1. At least some of hatches 17, may be transparent to enable a operator to watch over filling operations.

Machine 1, generally includes container sterilizing assembly 18, for aseptically sterilizing containers 2, container filling assmebly 19, for filling containers 2, with product, container discharge assembly 20, for discharging filled containers 2, from machine 1, and drive assembly 21, for moving containers 2, along conveying zone 9, through assemblies 18, 19 and 20.

Figure 2:
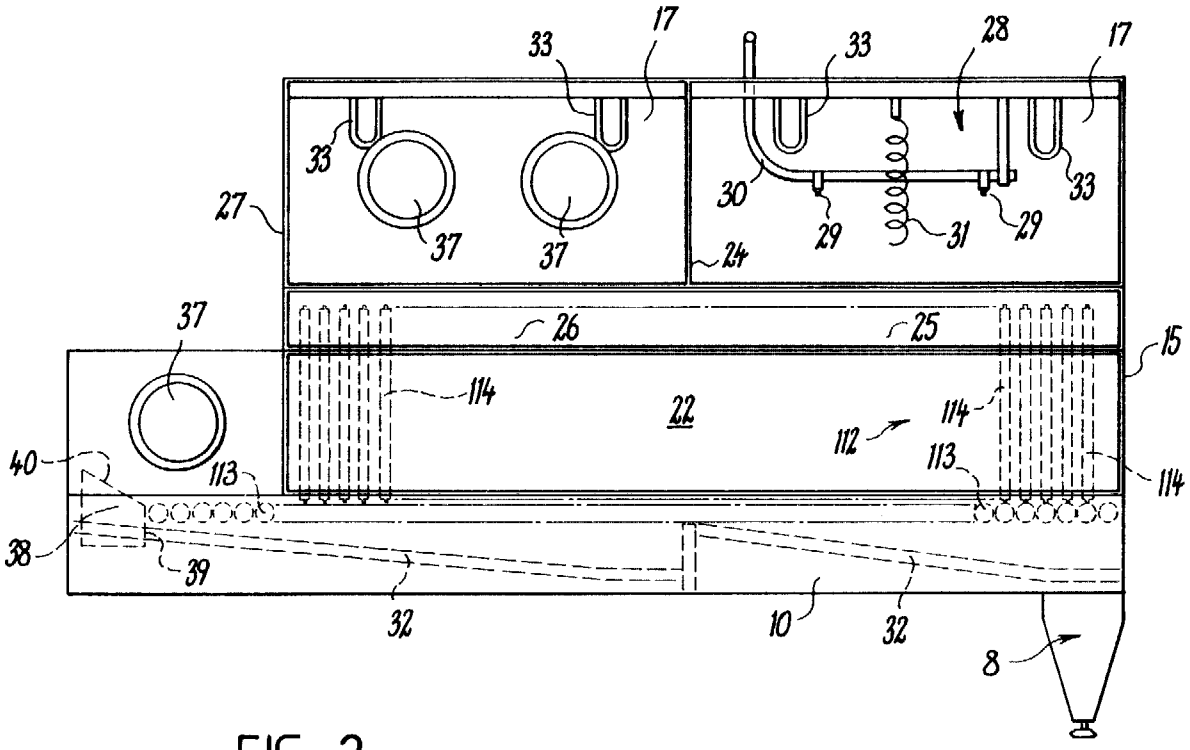
FIG. 2 is a detailed side elevational view illustrating a part of the machine of FIG. 1.
Figure 3:
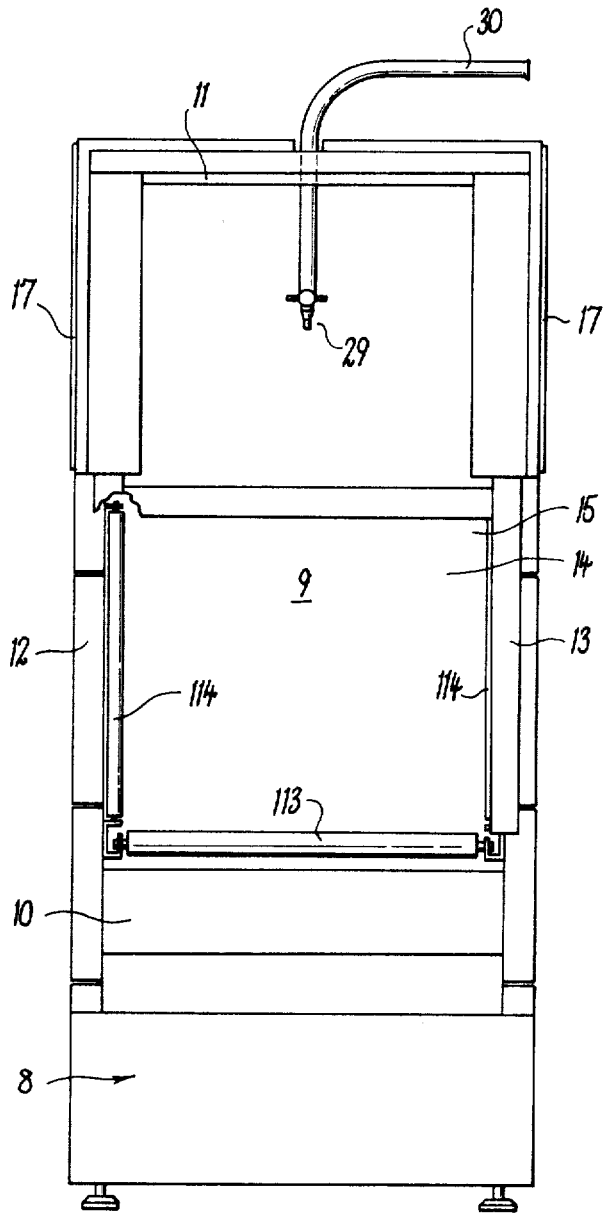
FIG. 3 is a detailed end elevational view of the machine part of FIG. 2.
Figure 4:
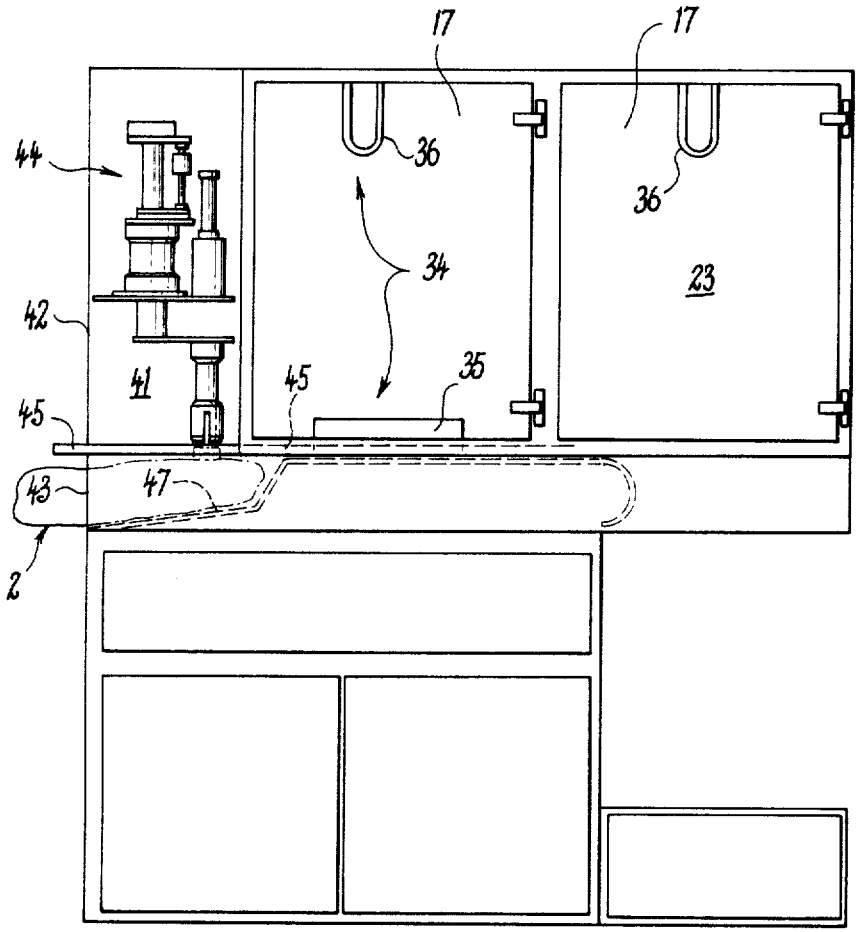
FIG. 4 is a detailed side elevational view illustrating a further part of the machine of FIG. 1.
Figure 6:
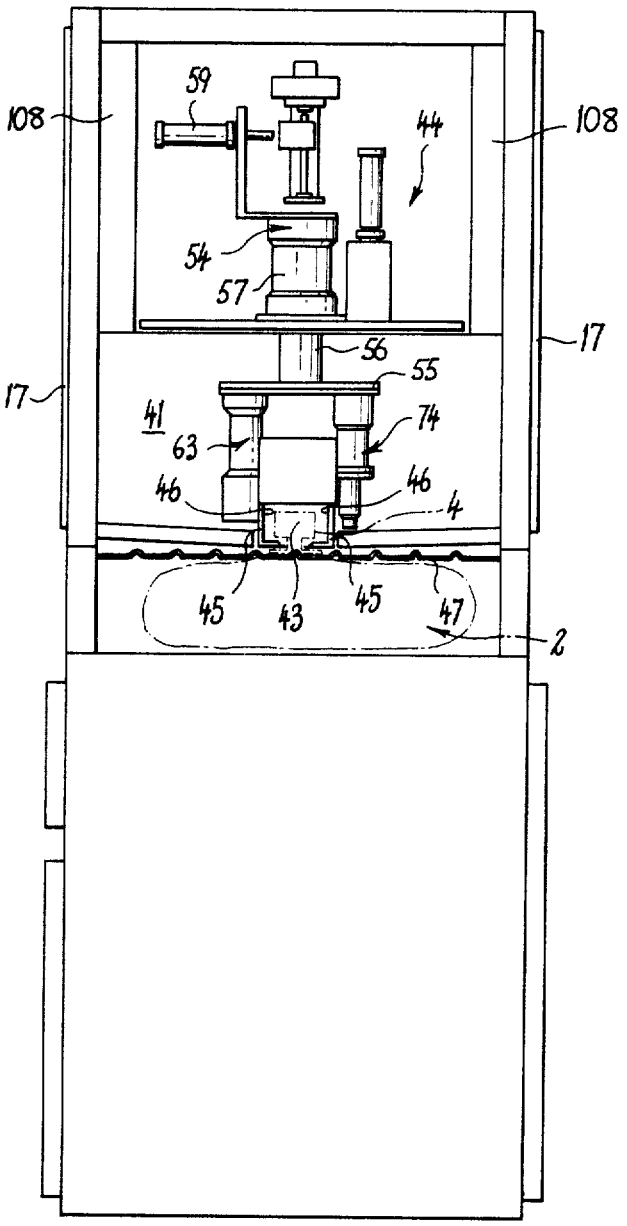
FIG. 6 is a detailed end elevational view of the machine part of FIG. 4.
Figure 7:
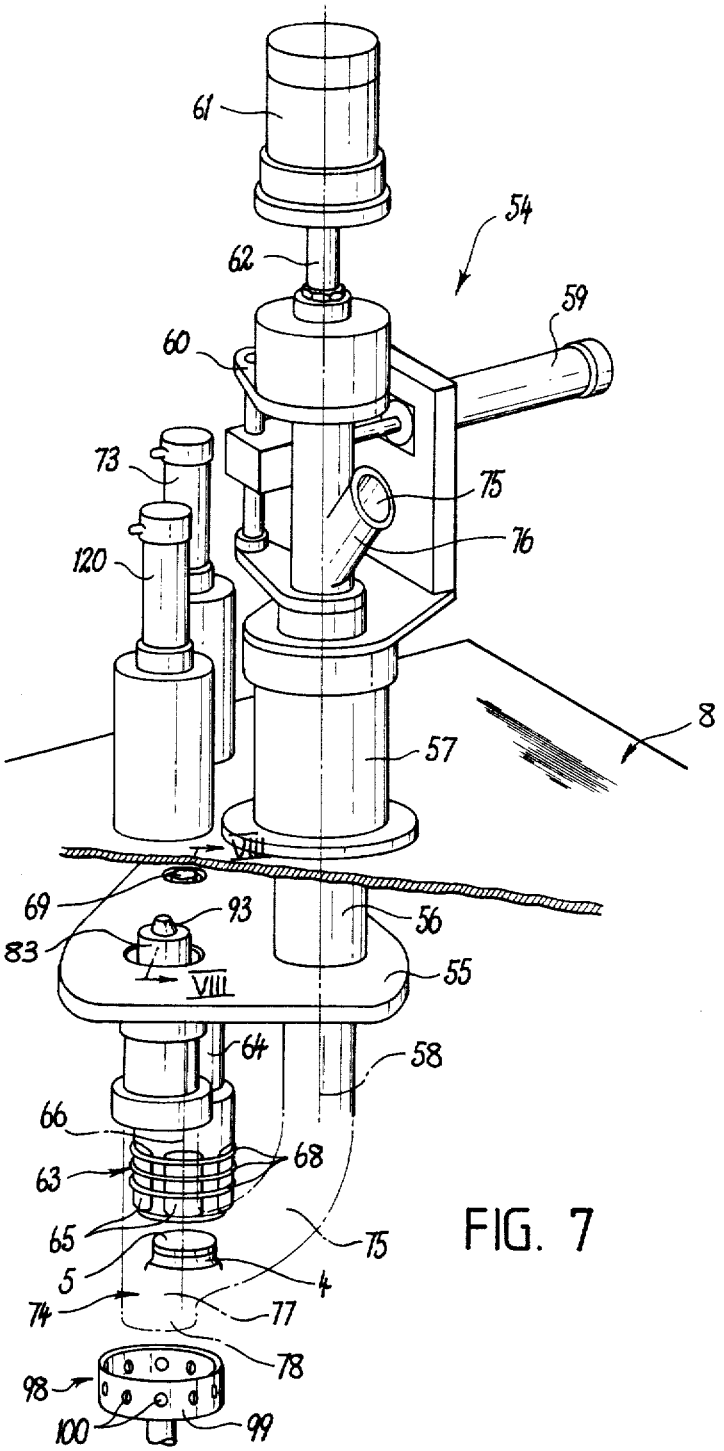
FIG. 7 is a detailed perspective view illustrating another part of the machine of FIG. 1.

Sterilizing assembly 18, is illustrated in detail in FIGS. 2 to 4, and defines upstream sterilizing sub-station 22, and downstream sterilizing sub-station 23, in conveying zone 9. Sterilizing assembly 18, can include movable inner partition door 24, for dividing upstream sterilizing sub-station 22, into regions 25, and 26. In addition, sterilizing assembly 18, may include outer partition wall 27, for at least substantially dividing upstream sterilizing sub-station 22, from downstream sterilizing sub-station 23. In this way, sub-station region 25, in particular and sub-station region 26, to a lesser extent of upstream sterilizing sub-station 22, can be enclosed and isolated.

Sterilizing assembly 18, includes preliminary sterilizing unit 28, (FIGS. 2 and 3) for sterilizing container pack 7, loaded into conveying zone 9, through inlet 14, and located at upstream sterilizing station 22. Preliminary sterilizing unit 28, includes a pair of spaced apart spray nozzles 29, mounted within sub-station region 25, and depending from top wall 11. Nozzles 29, are connectable through pipe 30, to a source of pressurized chemical sanitizing liquid (not shown) to spray wash the outer surface of the holding bag of container pack 7.

Preliminary sterilizing unit 28, may also include at least one electric heating element 31, mounted in upstream sterilizing sub-station region 25, and selectively operable to dry container pack 7, previously washed with sanitizing liquid sprayed from nozzles 29.

Preliminary sterilizing unit 28, further includes collection trays 32, positioned adjacent or formed from bottom wall 10, in sub-station regions 25, and 26, for collecting and removing sprayed sanitizing liquid from conveying zone 9. Each tray 32, may have a drain pipe (not shown) leading therefrom for collection and disposal or recirculation of the sanitizing liquid.

Preliminary sterilizing unit 28, also includes at least one low intensity ultraviolet light generator 33, operable to immerse container pack 7, in ultraviolet light rays. Each light generator 33, depends from top wall 11, and may be a water cooled lamp. A pair of generators 33, may be spaced apart in each of sub-station regions 25, and 26, of upstream sterilizing sub-station 22.

Sterilizing assembly 18, also includes main sterilizing unit 34, (FIG. 4) located in downstream sterilizing sub-station 23. Main sterilizing unit 34, includes high intensity ultraviolet light generator 35, in the form of a water-cooled lamp, positioned in sterilizing sub-station 23, so that containers 2, moving along conveying zone 9, will have that region thereof including closure sleeve 4, and closure cap 6, pass immediately therebeneath for immersion in the ultraviolet light rays. Main sterilizing unit 34, also includes at least one low intensity ultraviolet light generator 36, arranged in downstream sterilizing sub-station 23, so as to immerse at least the outer upper surface of bags 3, in ultraviolet light rays. At least two such generators 36, also in the form of water cooled lamps may be spaced about sterilizing sub-station 23, and depend from top wall 11.

Sterilizing assembly 18, also includes at least one manipulative element 37, mounted on machine frame 8, and adapted to allow manual manipulation of container pack 7, within upstream sterilizing sub-station 22, and to some extent also within downstream sterilizing sub-station 23. Each manipulative element 37, may be a surgical glove sealingly mounted on machine frame 8, so as to extend through side wall 12, or 13, into conveying zone 9, and into which a machine operator's arm may extent to allow manipulation of container pack 7. At least one pair of manipulative elements 37, can extend into each of upstream and downstream sterilizing sub-stations 22, and 23 (not all shown for reasons of simplicity).

Sterilizing assembly 18, further includes dump outlet 38, (FIG. 2) opening from downstream sterilizing sub-station 23, and through which the holding bag of container pack 7, can be discarded following dispensing of containers 2, from pack 7. Dump outlet 38, includes dump chute 39, sealable from within downstream sterilizing sub-station 23, by removable lid 40, manipulated by conveniently positioned manipulative element 37.

Container filling assembly 19, is illustrated in detail in FIGS. 4 to 8, and defines container filling station 41, in conveying zone 9, and at which containers 2, are actually filled with a product (not shown). Container filling assembly 19, is open to downstream sterilizing sub-station 23, but has a partition 42, dividing to isolate filling station 41, from discharge assembly 20, except for outlet opening 43, through which filled containers 2, move during machine operation. Outlet opening 43, is generally rectangular shaped and sized to neatly receive filled bag containers 2, therethrough.

Container filling assembly 19, includes container filling unit 44, arranged at or adjacent filling station 41. Filling unit 44, includes a pair of closely spaced apart guide rails 45, extending from within downstream sterilizing sub-station 23, through filling station 41, and out through outlet opening 43, thereof. Guide rails 45, are generally L-shaped and are arranged to face each other so that sleeve 4, of container 2, can extend therebetween and be slidingly supported thereby for sliding movement therealong. Guide rails 45, are rigidly mounted on machine frame 8, adjacent bottom wall 10, of conveying zone 9, and pass beneath high intensity light generator 35. That mounting positions rails 45, in a horizontal plane so that closure sleeves 4, guided thereby generally vertically upstanding therefrom with opening 5, facing upwardly.

Guide rails 45, vary in their relative spacing so that they are more closely spaced apart in filling station 41, than in downstream sterilizing sub-station 23. In this way, closure sleeve 4, of containers 2, can be easily received by and guided between rails 45, to minimise frictional resistance whilst in sterilizing sub-station 23, and is only retained in a close sliding and supporting fit between guide rails 45, at filling station 41, so as to positively locate and hold closure sleeve 4, for container filling.

Inner surfaces 46, of guide rails 45, may be highly polished or reflective so that ultraviolet light rays particularly from light generator 35, are reflected therefrom and concentrated about closure sleeve 4, and closure cap 6.

Container filling unit 44, also has support platform 47, extending beneath guide rails 45, from within downstream sterilizing sub-station 23, through filling station 41, to outlet opening 43, thereof. Support platform 47, acts to positively support container bags 3, between support platform 47, and guide rails 45, as they move through filling station 41, and particularly during and following filling with product. To allow for increased container size following filling, support platform 47, extends parallel and closely spaced beneath guide rails 45, in downstream sterilizing sub-station 23, but diverges downwardly therefrom in filling station 41, to outlet opening 43. Support platform 47, may be in the nature of a support plate or support rack.

Filling unit 44, also has a pair of locating arms 48, and 49, selectively actuable to grip and hold closure sleeves 4, of containers 2, when located in filling station 41. Each arm 48, 49, is mounted on a respective guide rail 45, and includes gripping finger 50, mounted on respective guide rail 45, for pivotal movement about axes 51, with finger 50, of arm 48, being located slightly downstream from finger 50, of arm 49. Each arm 48, 49, also includes actuating lever 52, pivotably connected to respective gripping finger 50, and actuable by respective linear motor 53, to pivotably move gripping fingers 50, about axes 51, toward and away from each other so as to respectively grip and release a closure sleeve 4, placed therebetween.

Filling unit 44, also includes filling head 54, (FIGS. 7 and 8) for actually attending to filling of containers 2, when located at filling station 41. Filling head 54, includes support plate 55, rigidly mounted on support rod 56, which in turn is mounted on machine frame 8, through bearing 57, for linear movement along and rotary movement about vertical axis 58, relative to machine frame 8. Support plate 55, is spaced immediately above guide rails 45, and gripping fingers 50, within filling station 41, so that it will be spaced above closure sleeve 4, of containers 2, positioned between gripping fingers 50, in filling station 41. Support rod 56, is pivotal about axis 58, by means of linear motor 59, mounted on machine frame 8, and connected eccentrically to rod 56, through linkage 60. Support rod 56, is linearly movable along axis 58, by means of further linear motor 61, also mounted on machine frame 8, and connected to rod 56, through connecting link 62.

Filling head 54, further includes closure cap removal mechanism 63, mounted on support plate 55, and operable to remove closure cap 6, from container 2, located in filling station 41, for filling of container 2, and subsequently replace that cap 6. Removal mechanism 63, includes tubular body 64, rigidly mounted on support plate 55, and projecting downwardly therefrom. A series of elongated gripping claws 65, are mounted on tubular body 64, and project downwardly thereof. Claws 65, are spaced apart about body 64, in a ring formation and are mounted for radial pivotal movement about individual axes 66. Tubular body 64, and claws 65, together define downwardly facing open mouth 67, for receipt of closure caps 6, therein during operation of machine 1.

Mounted on tubular body 64, is a series of resilient bands 68, extending circumferentially about body 64, and also gripping claws 65. Those bands 68, resiliently bias gripping claws 65, radially inwardly so as to extend parallel with body 64. Resilient bands 68, may be coil springs.

Figure 8:
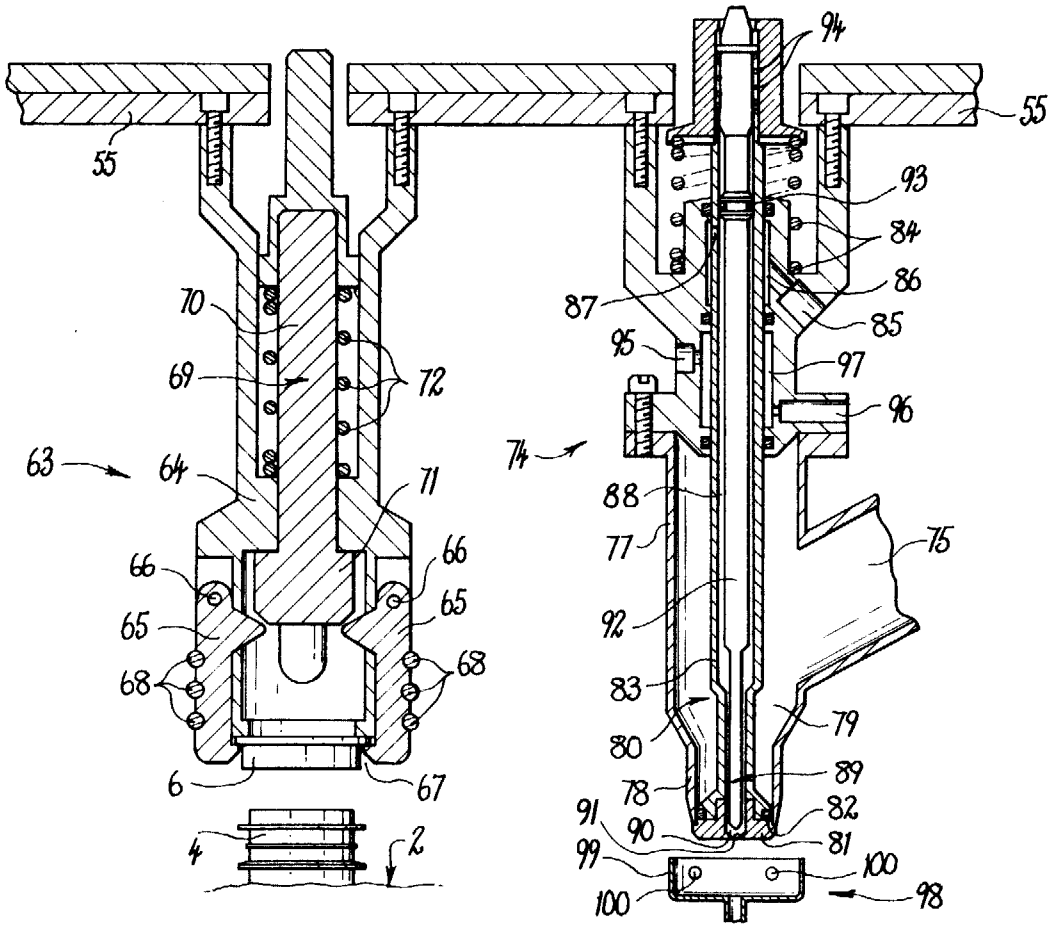
FIG. 8 is a detailed cross sectional view of a machine part as seen from VIII—VIII of FIG. 7.

Cap removal mechanism 63, further has cap seating plunger 69, operable to engage and move gripping claws radially outwardly against the bias of resilient bands 68, to cause them to release any closure cap 6, gripped therebetween and also to press that released closure cap 6, into engagement with closure sleeve 4. Seating plunger 69, has elongated shank portion 70, longitudinally slidable within tubular body 64, and head portion 71, located adjacent gripping claws 65, plunger 69, being movable between an inoperative position (as illustrated in FIG. 8) where head portion 71, is retracted from engagement with gripping claws 65, and an operative position in which head portion 71, engages gripping claws 65, and projects from mouth 67. Plunger 69, is resiliently biased into its inoperative position by means of coil spring 72, mounted for reaction between tubular body 64, and shank portion 70, and is movable to its operative position against that bias by action of linear motor 73, mounted on machine frame 8, immediately above where closure sleeve 4, will be gripped by arms 48, 49, in filling station 41.

Filling head 54, also includes filling nozzle 74, mounted on plate 55, and support rod 56, for movement therewith. Coveniently, support rod 56, is provided with passageway 75, extending between nozzle 74, and outlet 76, outlet 76, being connectable to a source of product (not shown) for delivery to nozzle 74. Filling nozzle 74, is circumferentially spaced apart from removal mechanism 63, about vertical axis 58, of support rod 56. In this way, during machine operation, support plate 55, can be rotated between positions where cap removal mechanism 63, and filling nozzle 74, are alternatively positioned beneath linear actor 73, and above closure sleeve 4, of container 2, positioned between gripping claws 65, in filling station 41.

Nozzle 74, has elongated body 77, which extends generally downwardly from support plate 55, to terminal nozzle nose 78. Nozzle 74, is generally tubular and thereby defines product passageway 79, connecting with passageway 75. Nozzle nose 78, is sized so as to project into opening 5, of closure sleeve 4, with nozzle nose 78, sealing against sleeve 4.

Filling nozzle 74, also has dispensing valve 80, selectively actuable to block and unblock passageway 79, thereby to respectively prevent and permit product dispensing through nozzle nose 78. Valve 80, includes valve closure plug 81, adapted to move toward and away from valve seat 82, to respectively block and unblock passageway 79. Valve closure plug 81, is mounted on and movable by hollow plunger stem 83, and is resiliently baised into passageway blocking engagement with valve seat 82, by spring 84, acting between body 77, and hollow plunger stem 83. Movement of plunger stem 83, and thus valve closure plug 81, to unblock passageway 79, against bias of spring 84, is achieved with linear motor 73.

Filling nozzle 74, is also selectively connectable to a source of vacuum and low positive pressure gas (not shown) and is operable to communicate that vacuum and gas through nozzle nose 78, to container 2. Connection of filling nozzle 74, to the source of vacuum occurs when filling nozzle nose 78, is sealed against closure sleeve 4, and prior to container filling so as to evacuate any air from container 2. That connection also occurs immediately following withdrawal of filling nozzle nose 78, from closure sleeve 4, after filling so that any drops of product on nozzle nose 78, can be removed and thereby minimise the possibility of those drops falling and contaminating either containers 2, or filling station 41. Connection of filling nozzle 74, to the source of pressure gas occurs upon completion of container filling and as filling nozzle 74, is about to be lifted away from sleeve 4, to assist in breaking the seal between sleeve 4, and filling nozzle nose 78, and thereby avoid splashing of product from sleeve 4. The gas may be nitrogen. That connection occurs through passageway 85, which communicates through relief 86, and port 87, to inner bore 88, hollow plunger stem 83. Although not shown, machine 1, provides for selective separate connection of the source of vacuum and the low pressure gas during machine operation, as will become more apparent hereinafter.

Filling nozzle 74, further includes control valve 89, selectively actuable to control connection of inner bore 88, through nozzle nose 78, and thus into opening 5, of container 2, during machine operation. Control valve 89, includes port 90, extending coaxially through valve closure plug 81, and defining seat 91, therein. Valve closure needle 92, is slidably mounted in inner bore 88, and adapted to move toward and away from seat 91, to respectively block and unblock port 90. Valve closure needle 92, protrudes from plunger stem 83, and is sealed thereto with O-ring 93, so as to confine vacuum and pressure gas in inner bore 88, and prevent escape except through port 90. Valve closure needle 92, is resiliently biased out of port blocking engagement with seat 91, by spring 94, acting between plunger stem 83, and closure needle 92. Movement of valve closure needle 92, against bias of spring 94, to block port 90, is achieved with linear motor 73, when plunger stem 83, is moved thereby.

Filling nozzle 74, also has inlet port 95, and outlet port 96, communicating through relief 97, in body 77. Ports 95, and 96, are connected to a source of steam (not shown) during machine operation to sterilize that region of plunger stem 83, facing relief 97, and which enters product passageway 79, to be contaminated thereby.

Filling unit 44, also includes nozzle cleansing device 98, mounted on machine frame 8, adjacent filling head 54, for cleansing nozzle nose 78, following each container filling operation. Cleansing device 98, is operable to liquid wash filling nozzle nose 78, when support plate 55, is rotated to move nozzle 74, away from closure sleeve 4, and move the removal mechanism 63, into registry therewith. Cleansing device 98, includes cleansing cup 99, into which filling nozzle nose 78, can extend and a series of spray jets 100, spaced about cup 99, and selectively connectable to a source of cleansing liquid (not shown), spray jets 100, operable to spray filling nose nozzle 78.

Figure 9:
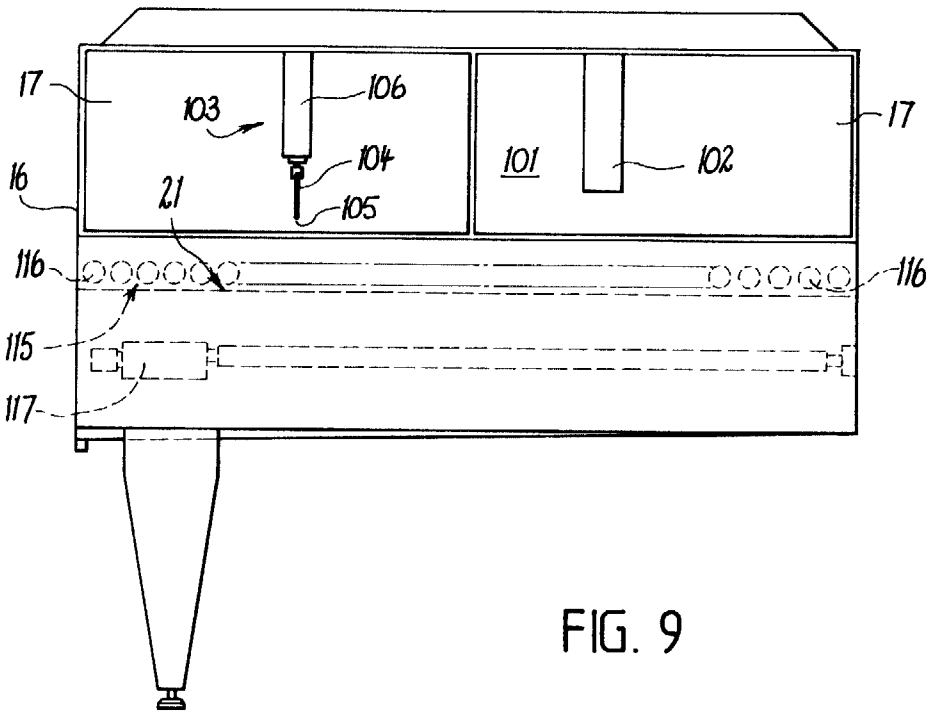
FIG. 9 is a detailed side elevational view illustrating yet a further part of the machine of FIG. 1; and, FIG. 10 is a detailed and elevational view of the machine part of FIG. 9.
Figure 10:
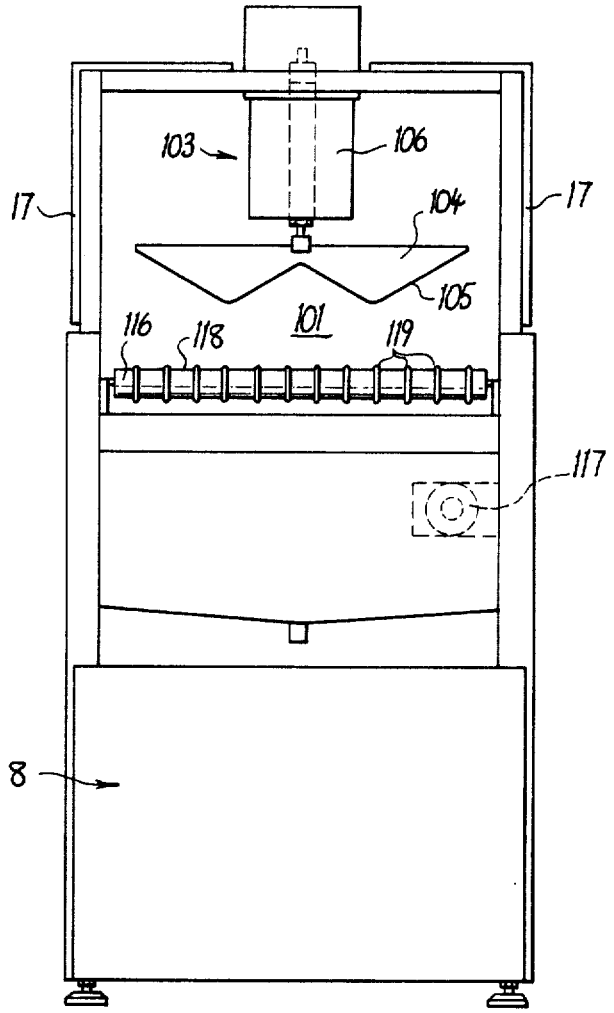

Discharge assembly 20, is illustrated in detail in FIGS. 9 and 10, and defines discharge station 101, in conveying zone 9. Discharge assembly 20, includes sealing device 102, operable to permanently seal closure caps 6, replaced on sleeves 4, following container filling. Sealing device 102, is located in discharge station 101, immediately downstream of filling station 41, and may be a suitable welding device such as an ultrasonic welder, construction of which is well known to those skilled in the relevant art.

Discharge assembly 20, also includes severing unit 103, operable to separate filled containers 2, as they are moved through discharge station 101, so that they are individually discharged from machine 1, through outlet 16. Severing unit 103, includes severing blade 104, mounted adjacent top wall 11, defining conveying zone 9. Severing blade 104, has cutting edge 105, extending longitudinally in a configuration. Severing blade 104, is mounted on linear motor 106, and through which blade 104, is mounted on machine frame 8. Actuation of linear motor 106, causes upward and downward movement of severing blade 104, in a guillotine action.

Although not shown, discharge assembly 20, may also include a discharge chute through which separated, filled containers 2, fall out of conveying zone 9, through outlet 16, for subsequent collection.

Machine 1, also includes pressurizing units 107, (FIGS. 1 and 6) connected to conveying zone 9, for supplying sterilized and pressurized air thereto. Pressurizing unit 107, ducts the air through coveying zone 9, via ducts 108, opening into filling station 41, to freely circulate within and between filling station 41, and downstream sterilizing sub-station 23. In addition, that pressurized air is free to leak into and then from upstream sterilizing sub-station 22, and discharge station 101, to provide at least partial pressurization of that sub-station 22, and station 101. Pressurizing unit 107, may be selectively operable to single pass and recirculatively duct the air into conveying zone 9.

Pressurizing unit 107, may include a pump device 109, operable to draw air from atmosphere surrounding machine 1, and pumping the air through incinerator 110, for sterilization and cooler 111, prior to delivery to ducts 108, and subsequent recirculation. Although not shown, pressurizing unit 107, may alternatively be an air cleaning sterilizer operable to draw air from a compressed air source and sterilize the air prior to delivery to ducts 108.

Machine 1, also includes drive assembly 21, for moving container pack 7, and containers 2, therein along conveying zone 9. Drive assembly 21, includes inlet conveyor 112, (FIGS. 2 and 3) comprising idler rollers rotatably mounted within sterilizing sub-station 22, and 23. One series of rollers 113, extends along bottom wall 10, of conveying zone 9, in both sub stations 22, and 23 whilst further series of rollers 114, extend along side walls 12, 13 of conveying zone 9, in upstream sterilizing sub-station 22. This inlet conveyor 112 is such that container packs 7, loaded into sterilizing sub-station are manually movable along the series of idler rollers 113, 114, therewithin.

Container packs 7, are loaded into conveying zone 9, so that they bear directly on conveyor roller series 113. Alternatively, however, drive assembly 21, may provide one or more support pallets (not shown) arranged to bear on conveyor roller series 113, and to support the container pack 7, thereon. These pallets may facilitate mechanical loading of container packs 7, into conveying zone 9, and also movement of packs 7, within sterilizing sub-stations 22, and 23. Where support pallets are provided, one of access hatches 17, may be positioned adjacent downstream sterilizing sub-station 23, to allow removal of those pallets following depletion of the containers 2, of pack 7, on the pallet within the sterilizing sub-station 23.

Drive assembly 21, also includes outlet conveyor 115, (FIGS. 9 and 10) extending along conveying zone 9, within discharge station 101, and operable to move filled containers 2, therethrough and discharge them from machine 1. Outlet conveyor 115, is a series of driven conveyor rollers 116, extending within discharge station 101, Roller series 116, is driven through suitable motor and drive transmission train 117, such as an air motor, drive shaft, and belt train.

Each roller in series 116, of outlet conveyor 115. may have outer surface 118, treated to facilitate frictional grip with filled containers 2. To that end, each roller in series 116, may be provided with an at least partially rubberised outer surface 118. That surface 118, may be provided by a rubberised coating or, as shown, a series of O-rings 119, spaced apart along each of rollers in series 116.

In this preferred form, outlet conveyor 115, may have a slight downward gradient from the container filling assembly 19, to conveying zone outlet 16, to facilitate container movement therethrough.

A variety of monitoring and control mechanisms may be provided to monitor and control the various functions of machine 1. In that regard, means (not shown) may be provided to monitor the number of bag containers 2, within machine 1, awaiting to be filled, the presence of closure cap 6, with each of those containers 2, the correct positioning of each container 2, on support platform 47, and within guide rails 45, prior to container filling, the maintenance of a positive pressure within at least filling station 41, the maintenance of a predetermined temperature within one or more stations 22, 23, 41, and 101, the hours of operation of ultraviolet light generators 33, 35, and 36, the sealing of filling nozzle nose 78, within closure sleeve 4, prior to filling, and the spillage of product or other contamination within conveying zone 9. Means (not shown) may be provided to control operation of, inter alia, washing spray jets 100, heating element 31, ultraviolet light generators 33, 35 and 36, filling head 54, movement involving closure cap removal mechanism 63, and filling nozzle 74, outlet conveyor 115, sealing device 102, and severing blade 104. Linear motors 53, 59, 61, 73, and 120, may be air operated piston and cylinder motors, the control means control flow of pressurized air to and from those motors.

Since efficient filling of containers 2, requires that filling nozzle nose 78, be properly inserted in, and sealed against closure sleeve 4, before and during container filling, the monitoring and control mechanisms may particularly include a nozzle check facility operable to check effectiveness of sleeve sealing before operation of dispensing valve 80, to dispense product is permitted. This facility may involve monitoring the effectiveness of the evacuation of container 2, by holding and monitoring the residual vacuum following the period of evacuation and, if the negative pressure decays toward zero, providing an indication to the machine operator that the seal between filling nozzle nose 78, and sleeve 4, is incomplete. Once the sealing has been checked and eventually completed then dispensing valve 80, can be operated to dispense product to container 2.

The majority of these monitoring and control means are located outside conveying zone 9, at least in filling station 41, to minimise potential contamination of that zone 9. Where those means of necessity extend into conveying zone 9, from outside machine 1, suitable aseptic seals (not shown) may be provided.

The monitoring and control means may be a combination of electronic and mechanical devices well recognised by those skilled in this art. Wherever practical in this form, those devices preferably automatically function to facilitate automatic operation of the machine.

In order to further understand machine 1, of the present invention, operation of the preferred embodiment thereof as outlined above will now be described.

Prior to any period of operation of machine 1, that machine 1, is caused to automatically undergo a sterilizing procedure to ensure that machine 1, is sterilized for operation. To that end, the control means is operated so that support plate 55, is rotated and lowered under action of linear motors 59, and 61, until filling nozzle nose 78, is positioned within cleansing cup 99, and dispensing valve 80, is actuated by linear motor 120, mounted on manchine frame 8, to unblock product passageway 79, to allow sterilization of all product delivery lines. The control means additionally causes the gas pump device 109, to operate so that sterilized air is ducted into conveying zone 9, at least in downstream sterilizing sub-station 23, and filling station 41. That air is filtered to about 25 micron and then passed through incinerator 110, raising the air to a temperature of approzimately 300° C. Prior to direct circulation through ducts 108, and within conveying zone 9. At this air temperature, all living bacteria are destroyed. Metal components of machine 1, contacted by this hot dry air are raised to a temperature in the region of 150° C.

When the required sanitizing temperature is reached it will be monitored for a set time and recorded on a chart recorder and at the completion of that heating period, the air will be diverted through cooler 111, to lower its temperature to approximately 45° C. This air can then be continued to be ducted through ducts 108, into at least downstream sterilizing sub-station 23, and filling station 41, and used as the low pressure sterile air for maintaining conveying zone 9, at a positive pressure throughout the filling operation. During machine operation, a large percentage of the air will be recycled by gas pump device 109, along with a volume of makeup air replacing air vented through inlet 14, and outlet 16, of conveying zone 9.

In operating machine 1, an operator working in a clean environment adjacent machine 1, removes any outer storage or transportation packaging (not shown) from container pack 7, to leave the holding bag closed about bag containers 2. This container pack 7, is then loaded into conveying zone 9, through inlet 14, and placed in the upstream sterilizing sub-station region 25.

The operator then isolates that region 25, by closing inlet closure door 15, and inner partition door 24, and initiates spray washing and drying of the holding bag. That washing and drying is a timed function with the operator being alerted by the control means as to the end of that function. The holding bag and containers 2, are then immersed in ultraviolet light rays from light generators 33, in upstream sterilizing sub-station region 25.

Once container pack 7, has been washed and dried, inner partition door 24, is opened and pack 7, manually moved into upstream sterilizing sub-station region 26, and partition door 24, again closed. There the operator will slit the holding bag to reveal bag containers 2. Access for that splitting is through manipulative elements 37, extending into that sub-station region 26. In region 26, the holding bag and containers 2, are again immersed in ultraviolet light rays from light generators 33, in that region 26.

A leading bag container 2, in slit container pack 7, is then removed from pack 7, and clipped to a draw cord (not shown) threaded through conveying zone 9, prior to machine sterilization. That cord passes through conveying zone outlet 16, and is gripped by the operator to draw successive bag containers 2, from pack 7, onto support platform 47, with closure sleeves 4, in sliding engagement with guide rails 45. As bag containers 2, are drawn through downstream sterilizing sub-station 23, they are immersed in ultraviolet light rays from light generators 35, and 36, and so sterilized prior to moving to filling station 41.

As the leading bag container 2, approaches filling station 41, it will satisfy a bag container present sensor of the control means so that downstream gripping arm 48, will be actuated by respectiye linear motor 53, to block closure sleeve passage along guide rails 45. When at filling station 41, upstream gripping arm 49, will be actuated by respective linear motor 53, to cause closure sleeve 4, of that leading bag container 2, to be firmly gripped between fingers 50, of the gripping arms 48, 49.

The operator then operates the control means to initiate filling of that leading bag container 2. In that regard, cap removal mechanism 63, is initially placed inmediately above closure cap 6, and, with plunger 69, in its inoperative position, filling head support plate 55, lowered under action of linear motor 61, until removal mechanism gripping claws 65, extend over and about to resiliently engage closure cap 6, in mouth 67. Filling head support plate 55, is then raised with linear motor 61, with removal mechanism 63, withdrawing closure cap 6, from closure sleeve 4.

Filling head support plate 55, is then rotated about axis 58, under action of linear motor 59, until filling nozzle 74, is located immediately above closure sleeve 4, and then plate 55, is again lowered with linear motor 61, until filling nozzle nose 78, enters opening 5, and seals against the periphery of closure sleeve 4. At this stage passageway 85 is connected to the source of vacuum and with needle 92, unblocking port 90, due to bias of spring 94, air is caused to be evacuated from bag container 2. Following evacuation and (if provided) confirmation of the effectiveness of the seal between filling nozzle nose 78, and closure sleeve 4, the control means actuates linear motor 73, to push plunger stem 83 and needle 92 against their respective biasing springs 84 and 94. Because of the relative positions of plunger stem 83, and needle 92, linear motor 73, initially actuates needle 92, blocking port 90 and so ending air withdrawal. Immediatley, thereafter linear motor 73, actuates plunger stem 83, which in turn actuates dispensing valve 80, to unblock passageway 79, and allow a preset quantity of product to be delivered through passageways 75, and 79, to that bag container 2. During this delivery passageway 85, is connected to the source of low pressure nitrogen.

Upon completion of bag container filling linear motor 73, is again actuated to release plunger stem 83 and needle 92, causing dispensing valve 80, to initially block passageway 79, then unblock part 90 to deliver low pressure nitrogen to opening 5. Support plate 55, is then raised slowly with linear motor 61 to lift filling nozzle nose 78, out of sleeve 4, to avoid product splashing, the low pressure nitrogen assisting separation between nozzle 74, and product.

While filling nozzle nose 78, is above sleeve 4, and for about 200 milliseconds before support plate 55, further moves away, filling nozzle 74, is reconnected to the source of vacuum through passageway 85, to draw any drops of product on filling nozzle nose 78, into inner bore 88, and eventually out thfough passageway 85.

Support plate 55, is then completely retracted and then rotated under action of linear motor 59, so positioning filling nozzle 74, above cleansing cup 99, and repositioning removal mechanism 63, above closure sleeve 4. Again, lowering support plate 55, with linear motor 61, causes filling nozzle nose 74, to enter cleansing cup 99, for washing with a cleansing liquid, and closure cap 6 to re-engage with closure sleeve 6. The control means then causes linear motor 73, to move plunger 69, from its inoperative position to its operative position where it moves gripping claws 65, against the resilient bias of resilient bands 68, and so out of contact with closure cap 6, and presses closure cap 6, into firm engagement with closure sleeve 4. With plunger 69, maintained in its operative position, filling head support plate 55, is then raised with linear motor 61, to clear removal mechanism 63, from filled bag container 2, and linear motor 73, retracted to allow plunger 69, to return to its inoperative position.

Locating arms 48, 49 then release closure sleeve 6, so that filled leading bag container 2, can be then manually drawn out of filling station 41, to discharge station 89, where operation of outlet conveyor 115, moves that leading bag container 2, through that station 101, and simultaneously draws a successive bag container 2, into container filling station 41, for filling as above. Following welding of closure cap 6, to closure sleeve 4, by the ultrasonic welder 102, and separation of leading bag container 2, from the pack 7, with severing blade 104, that filled container 2, is conveyed through outlet 16, of conveying zone 9, and the discharge chute (not shown).

Until two filled bag containers 2, are pulled through filling station 41, onto outlet conveyor 115, the operator will be required to manually draw containers 2, along conveying zone 9, with the draw cord. Once those two containers 2, are on outlet conveyor 115, then the draw cord can be unhooked and outlet conveyor 115, will operate to continuously draw containers 2, from pack 7, and through conveying zone 9.

If, for any reason, a spillage of product should occur during the filling, machine operation can be stopped and a wash down programme initiated. A series of fixed spray heads (not shown) spaced along conveying zone 9, can spray cleanse and sterilize that zone 9, to wash away the residue of that product. That wash down programme may be timed for approximately 3 minutes and then machine 1, can be set for a further filling operation.

In normal operation, machine 1, will have at least two container packs 7, within conveying zone 9, one in each of the upstream and downstream sterilizing sub-stations 22, and 23, one pack 7, having containers 2, being drawn therefrom for filling and the other pack 7, in readiness upon depletion of that one pack 7. To ensure that the filling operation is not delayed following completion of the one container pack 7, the leading container 2, of the other container pack 7, in upstream sub-station 22, is connected to the last container 2, of the one container pack 7, in the downstream sub-station 23, by the operator while the one container pack 7, is being filled. That connection can be achieved with adhesive tape applied to either the last container 2, of the one container pack 7, or the leading container 2, of the other container pack 7, during pack manufacture. Thus, when the one container pack 7, is depleted the other pack 7, will automatically commence being filled. The machine can be provided with visual indication through the access hatches 17, to advise the operator that the one container pack 7, is depleted so that the other container pack 7, should be moved into downstream sub-station 23, and a further container pack 7, loaded into upstream sub station 22. The monitoring means may provide an alarm indication should that function not be carried out.

The present invention provides a machine and method which can operate to fill containers in an aseptic condition. In an example application of that machine, it is particularly suitable for filling flexible bag containers with liquid food and drink. In the result, containers so filled with the machine can maintain the product in a usable condition for a longer period of time when compared with previous filling machines.

The machine and method of the present invention enables rapid continuous filling of containers with minimal possibility of interruption through incorrect container feeding or filling. As such, container filling can be achieved economically and efficiently thereby minimising ultimate cost of the product to the consumer.

It will be appreciated that various modifications and/or alterations may be made to the container filling machine and method without departing from the ambit of the present invention as defined in the claims appended hereto.

We claim:

1. A machine for filling flexible containers under aseptic conditions, each container having a spout adapted to be closed by a separable cap, a plurality of the containers being joined together end-to-end to form a continuous row of containers and being packaged in an outer container, the machine including: a machine frame defining a container conveying zone through which the joined row of containers are fed one by one during machine operating; a container sterilizing assembly on the machine frame and defining a loading station in the conveying zone for receiving the packaged row of containers, the loading station being maintained under aseptic conditions during machine operation and allowing opening of the outer container for feeding of the row of containers along the conveying zone, and the container sterilizing assembly operable to sterilize the outer container with the row of containers packaged therein, said container sterilizing assembly provided with means for sterilizing the separable caps and spouts by application of sterilizing radiation to the row of containers once the row of containers is removed from the outer container; a container filling assembly on the machine frame and defining a filling station in the conveying zone, the filling station arranged to receive a continuous stream of sterilized gas during machine operation which maintains the filling station at a pressure at least marginally above atmospheric pressure, and the container filling assembly operable to receive the row of containers fed one by one along the conveying zone from the loading station, remove the separable caps from each received container, fill each received container, and then replace the separable cap; and, a container discharge assembly on the machine frame and defining a discharge station in the conveying zone, the discharge assembly operable to receive the row of containers fed one by one along the conveying zone from the filling station.

2. A machine as claimed in claim 1, wherein the sterilized gas is air introduced into the conveying zone at the container filling station.

3. A machine as claimed in claim 1, wherein the conveying zone has an inlet through which the packaged row of containers is passed into the loading station, and an outlet through which the containers when filled pass to be discharged from the conveying zone, the machine frame entirely enclosing the conveying zone between the inlet and outlet.

4. A machine as claimed in claim 1, and further including a conveyor drive assembly operable to move the container through the conveying zone.

5. A machine as claimed in claim 4, wherein the drive assembly is arranged to move containers through the conveying zone in seriatim, each container moving through the conveying zone in discrete step movements so that the containers at least momentarily stop at the filling station and discharge station.

6. A machine as claimed in claim 4, wherein the drive assembly includes a series of conveying rollers on which the containers bear, at least some of the rollers being selectively drivable to move the containers through the conveying zone, and at least some of the rollers having an outer surface treated to facilitate frictional engagement with the containers bearing thereon.

7. A machine as claimed in claim 1, wherein the sterilizing assembly includes a preliminary sterilizing unit adjacent the conveying zone and operable to sterilize the outer container in the loading station.

8. A machine as claimed in claim 7, wherein the preliminary sterilizing unit wash cleanses the outer container.

9. A machine as claimed in claim 8, wherein the preliminary sterilizing unit includes at least one spray nozzle connectable to a source of pressurized chemical sanitizing liquid wash to spray the outer container, and at least one electric heating element operable to evaporate the liquid wash to dry the outer container.

10. A machine as claimed in claim 8, wherein the preliminary sterilizing unit immerses the container in high frequency light radiation.

11. A machine as claimed in claim 10, wherein the preliminary sterilizing unit includes at least one low intensity ultraviolet radiation generator to immerse the containers in ultraviolet radiation.

12. A machine as claimed in claim 7, wherein the sterilizing assembly includes a main sterilizing unit adjacent the conveying zone and located downstream of the preliminary sterilizing unit and operable to sterilize at least the caps and spouts of the containers.

13. A machine as claimed in claim 12, wherein the main sterilizing unit immerses the container caps and spouts of the containers in high frequency light radiation.

14. A machine as claimed in claim 13, wherein the main sterilizing unit includes at least one high intensity ultraviolet radiation generator to immerse the containers caps and spouts in ultraviolet radiation, and at least one low intensity ultraviolet radiation generator to immerse the container in ultraviolet radiation.

15. A machine as claimed in claim 13, wherein at least some surfaces of the machine are highly polished to act as reflectors of radiation received by those surfaces to reflect the radiation toward the container caps and spouts.

16. A machine as claimed in claim 1, wherein the filling assembly includes a filling unit adjacent the conveying zone, the filling unit having at least one guide element extending through the filling station for supportingly guiding the container therethrough.

17. A machine as claimed in claim 16, wherein the filling unit also has at least one locating element selectively operable to positively locate and hold the container, at the spout thereof, at the filling station in a predetermined filling position for filling with product.

18. A machine as claimed in claim 17, wherein a pair of guide elements are provided, the guide elements extending in closely spaced apart relationship from the loading station through the filling station and arranged so as to support for sliding movement therealong the container spouts.

19. A machine as claimed in claim 18 wherein a pair of locating elements are provided, the locating elements being selectively actuable to grip and hold the spouts supported between the guide elements when the containers are in the predetermined filling position.

20. A machine as claimed in claim 19, wherein each locating element includes a locating arm mounted on a respective guide element, each locating arm having a gripping finger pivotably mounted on the respective guide element with one gripping finger located slightly downstream in the filling station from the other gripping finger, each locating arm also having an actuating lever pivotably connected to the gripping finger and actuable to pivotably move the gripping finger toward and away from the other gripping finger thereby to respectively grip and release a contained spout positioned therebetween.

21. A machine as claimed in claim 1, wherein the filling assembly includes a filling head connectable to a source of product and operable to inject a portion thereof through the spouts in the container when at the filling station, the filling head movable toward the container for injection of product into the container spouts for container filling and away from the container following container filling.

22. A machine as claimed in claim 21, wherein the filling head includes a cap removal mechanism operable to remove the separable caps from the container spouts when the container to be filled is at the filling station, and thereafter replace the cap when the container has been filled with product.

23. A machine as claimed in claim 22, wherein the cap removal mechanism includes: a series of gripping claws arranged in a ring formation for grippingly engaging the caps therebetween, the closure removal mechanism being mounted on the machine frame for movement of the gripping claws toward and away from the containers when at the filling station to respectively replace and remove a cap engaged by the gripping claws.

24. A machine as claimed in claim 23, wherein the cap removal mechanism also includes: a tubular body, the gripping claws mounted on the body for radial movement relative thereto; at least one resilient biasing band extending about the gripping claws to bias the claws radially inwardly for engagement with a cap; and, an actuating plunger operatively movable along the tubular body into engagement with the gripping claws to move the claws radially outwardly against the resilient bias of the biasing band and thereby cause the gripping claws to release a cap gripped therebetween.

25. A machine as claimed in claim 24, wherein the plunger is operatively movable to positively push a cap gripped between the gripping claws into a position closing the respective container spout.

26. A machine as claimed in claim 21 wherein the filling head includes a filling nozzle having a nozzle nose through which product is injected into the containers, the nozzle nose projecting into the spouts of the containers when at the filling station so as to seal the nozzle nose against the periphery of the spouts during container filling.

27. A machine as claimed in claim 26, wherein the filling nozzle is operatively connectable to a source of vacuum when the nozzle nose seals against the spout periphery to evacuate the container prior to filling with product.

28. A machine as claimed in claim 26, wherein the filling nozzle is operatively connectable to a source of vacuum during or immediately following withdrawal of the nozzle nose from the container spouts thereby to draw into the nozzle any drops of product formed on the nozzle nose.

29. A machine as claimed in claim 28, wherein the filling nozzle is operatively connectable to a source of positive pressure gas immediately following container filling thereby to facilitate breaking of the seal between the nozzle nose and the spout periphery of the containers.

30. A machine as claimed in claim 26, wherein the filling assembly also includes: a nozzle cleansing device operable to cleanse the nozzle nose following filling of each of the containers with product.

31. A machine as claimed in claim 30, wherein the nozzle cleansing device includes a cleansing cup into which the nozzle nose projects, and at least one spray jet positioned in the cleansing cup and operatively connectable to a source of cleansing liquid to spray cleanse the nozzle nose when projecting into the cleansing cup.

32. A machine as claimed in claim 1, wherein the discharge assembly includes a sealing device operable to permanently seal the separable caps on the containers at the discharge station.

33. A machine as claimed in claim 32, wherein the sealing device is a welding device which welds the caps on to the container spouts.

34. A machine as claimed in claim 1, wherein the container discharge assembly includes a severing unit operable to separate the filled containers as they are successively received at the discharge station so that they are subsequently individually discharged one by one from the machine.

35. A machine as claimed in claim 34, wherein the severing unit includes a severing blade having a cutting edge which extends longitudinally in a W-configuration, the severing blade moving in a guillotine action to separate the filled containers.

36. A method of filling flexible containers under aspetic conditions, each container having a spout adapted to be closed by a separable cap and a plurality of the flexible containers being joined together end-to-end to form a continuous row of containers, said method including: packaging the joined row of containers in an outer container and sterilizing the row of containers and the interior of the outer container; placing the packaged row of containers in a loading station maintained under aseptic conditions and subjecting the outer container to sterilization in the loading station; opening the outer container and feeding the joined row of containers packaged therein one by one to a filling station, the filling station being provided with a continuous stream of sterilized gas which maintains the filling station at a pressure at least marginally above atmospheric pressure; subjecting each separable cap and spout to a sterilization operation by sterilizing the separable caps and spouts by irradiation with sterilizing radiation; removing the cap and filling each container at the filling station; replacing each cap; and, feeding each filled container to a discharge station.

37. A method as claimed in claim 36, wherein outer container sterilization includes wash cleansing the outer container.

38. A method as claimed in claim 37, wherein cap and spout sterilization includes immersing the caps and spouts of the containers in high frequency light radiation.

39. A method as claimed in claim 38, wherein the container caps and spouts are immersed in high intensity ultraviolet radiation.

40. A method as claimed in claim 38, wherein the high intensity ultraviolet radiation is directed from an ultraviolet radiation source directly onto the caps and spouts and by reflection from reflectors arranged along a conveying zone between the loading zone and filling zone.

41. A method as claimed in claim 36 and further including supportingly guiding the containers through the filling station and releasably locating and holding the containers adjacent the spouts thereof, at the filling station in a predetermined filling position for filling with product.

42. A method as claimed in claim 36, wherein container filling includes: projecting a filling nozzle having a nozzle nose into the spouts of the containers, connecting the filling nozzle to a source of product to fill the containers with a portion thereof through the nozzle nose; and, removing the filling nozzle from the container spouts following container filling.

43. A method as claimed in claim 42, wherein container filling further includes: sealing the nozzle nose against the periphery of the container spouts following projection into the spouts; and, maintaining the seal during container filling.

44. A method as claimed in claim 43, wherein container filling further includes: connecting the filling nozzle to a source of vacuum following sealing of the nozzle nose against the spout periphery thereby to evacuate the containers prior to filling with product.

45. A method as claimed in claim 43, wherein container filling further includes: connecting the filling nozzle to a source of vacuum during or immediately following withdrawal of the filling nozzle nose from the container spouts thereby to draw into the nozzle any drops of product formed on the nozzle nose.

46. A method as claimed in claim 43, wherein container filling further includes: connecting the filling nozzle to a source of positive pressure gas immediately following container filling thereby to facilitate breaking of the seal between the nozzle nose and spout periphery of the containers.

47. A method as claimed in claim 43, and further including cleansing the nozzle nose following each container filling.

48. A method as claimed in claim 53, wherein nozzle nose cleansing includes: extending the nozzle nose into a cleansing cup and spray cleansing the nozzle nose with cleansing liquid.

49. A method as claimed in claim 36, further including: permanently sealing the spearable caps on the containers at the discharge station.

50. A method as claimed in claim 49, wherein sealing the caps on the containers includes: welding the caps to the container spouts.

51. A method as claimed in claim 36, further including: separating the containers at the discharge station for individual discharge one by one from the discharge station.

* * * * *